US006340377B1

(12) United States Patent
Kawata et al.

(10) Patent No.: US 6,340,377 B1
(45) Date of Patent: Jan. 22, 2002

(54) HIGH-TEMPERATURE WEAR-RESISTANT SINTERED ALLOY

(75) Inventors: Hideaki Kawata; Kei Ishii; Koichiro Hayashi; Yoshimasa Aoki, all of Chiba; Atsushi Ehira, Kanagawa; Kunio Maki; Masaki Toriumi, both of Yokohama, all of (JP)

(73) Assignees: Hitachi Powdered Metals Co., Ltd., Chiba; Nissan Motor Co., Ltd., Kanagawa, both of (JP)

( * ) Notice: Subject to any disclaimer, the term of this patent is extended or adjusted under 35 U.S.C. 154(b) by 0 days.

(21) Appl. No.: 09/547,340

(22) Filed: Apr. 11, 2000

(30) Foreign Application Priority Data

Apr. 12, 1999 (JP) ..... 11-104435

(51) Int. Cl.[7] ..... C22C 33/00

(52) U.S. Cl. ..... 75/236; 75/231; 75/240; 75/243; 75/246

(58) Field of Search ..... 75/231, 243, 246, 75/236, 240

(56) References Cited

U.S. PATENT DOCUMENTS

| | | | | |
|---|---|---|---|---|
| 4,121,927 A | * | 10/1978 | Lohman et al. | |
| 4,504,312 A | * | 3/1985 | Oaku et al. | 75/244 |
| 4,505,988 A | * | 3/1985 | Urano et al. | 428/569 |
| 4,552,590 A | * | 11/1985 | Nakata et al. | 75/246 |
| 5,031,878 A | * | 7/1991 | Ishikawa et al. | 251/368 |
| 5,462,573 A | * | 10/1995 | Baker et al. | 75/231 |
| 5,756,909 A | * | 5/1998 | Liimatainen et al. | 75/238 |
| 5,949,003 A | | 9/1999 | Aoki et al. | 75/246 |

FOREIGN PATENT DOCUMENTS

| | | | |
|---|---|---|---|
| EP | 0339436 A1 | * | 11/1989 |
| GB | 2116207 | * | 3/1982 |
| JP | 1-51539 | | 11/1989 |
| JP | 5-9667 | | 1/1993 |
| JP | 5-55593 | | 8/1993 |
| JP | 7-233454 | | 9/1995 |
| JP | 10-310851 | | 11/1998 |

* cited by examiner

*Primary Examiner*—Ngoclan Mai
(74) *Attorney, Agent, or Firm*—McDermott, Will & Emery

(57) ABSTRACT

The invention relates to an iron-based high-temperature wear-resistant sintered alloy. This alloy contains 3.74–13.36 wt % W, 0.39–5.58 wt % V, 0.2–5.78 wt % Cr, 0.1–0.6 wt % Si, 0.39–1.99 wt % Mn, 0.21–1.18 wt % S, and up to 2.16 wt % C. This alloy includes 20–80 wt % of a first phase and 80–20 wt % of a second phase, each distributed therein, in the form of spots. The first phase contains 3–7 wt % W, up to 1 wt % Cr, 0.1–0.6 wt % Si, 0.2–1 wt % Mn, 0.1–0.6 wt % S, and up to 2.2 wt % C. The first phase may contain 0.5–1.5 wt % V, and in this case the vanadium content of the alloy becomes 0.79–5.88 wt %. The second phase contains 7–15 wt % W, 2–7 wt % V, 1–7 wt % Cr, 0.1–0.6 wt % Si, 0.2–1 wt % Mn, 0.1–0.6 wt % S, and up to 2.2 wt % of C. Each phase contains 0.3–1.6 wt % MnS and a carbide of at least tungsten, which are dispersed therein. The second phase further contains 10–20 areal % tungsten carbide (particle diameter: $\geqq 1$ $\mu$m) dispersed therein. The alloy further contains 0.3–16 wt % MnS grains dispersed in grain boundaries and/or pores. The alloy is greatly improved in wear resistance, while suppressing damage to mating part in contact with the alloy.

12 Claims, 7 Drawing Sheets

HIGH-TEMPERATURE WEAR-RESISTANT SINTERED ALLOY

BACKGROUND OF THE INVENTION

The present intention relates to an iron-based sintered alloy which is wear-resistant at high temperature. Such sintered alloy is preferably used as a material for mechanical parts (e.g., such as valve seat insert used in internal combustion engine) that require wear resistance at high temperature.

Japanese Patent Examined Publication JP-B-5-55593 and Japanese Patent Unexamined Publication JP-A-7-233454 disclose high-temperature wear-resistant sintered alloys each being high in cobalt content. However, the production cost of these sintered alloys is high, due to the use of relatively large amounts of cobalt.

JP-A-5-9667 discloses an iron-based sintered alloy containing an iron-based matrix and an ironbased hard phase dispersed in the matrix. The hard phase contains C, Cr, Mo, W, V, Si, and Mn. JP-B-1-51539 discloses an iron-based sintered alloy containing an iron-based matrix and a dispersed phase containing Cr, C, Mo, Si, and at least one selected from Nb, Ta, Ti and V. According to these patent publications '667 and '539, however, it is difficult to prepare a sintered alloy that is superior in wear resistance and at the same time is weak in the property of damaging another member that is in contact with the sintered alloy U.S. Pat. No. 5,949,003, corresponding to JP-A-10-310861, discloses a high-temperature wear-resistant sintered alloy.

SUMMARY OF THE INVENTION

It is an object of the present invention to provide a sintered alloy that is greatly improved in wear resistance at high temperature and compatibility, while suppressing damage to mating part that is in contact with the sintered alloy.

According to a first aspect of the present invention, there is provided a first high-temperature wear-resistant sintered alloy. This sintered alloy comprises, based on a total weight of the sintered alloy, 3.74–13.36 wt % of W, 0.39–5.58 wt % of V, 0.2–5.78 wt % of Cr, 0.1–0.6 wt % of Si, 0.39–1.99 wt % of Mn, 0.21–1.18 wt % of S, up to 2.16 wt % of C, and a balance consisting of Fe and inevitable impurity. The sintered alloy includes a first phase comprising, based on a total weight of the first phase, 3–7 wt % of W, up to 1 wt % of Cr, 0.1–0.6 wt % of Si, 0.2–1 wt % of Mn, 0.1–0.6 wt % of S, up to 2.2 wt % of C, and a balance consisting of Fe and inevitable impurity. This first phase may further comprises 0.5–1.5 wt % of V. The sintered alloy further includes a second phase comprising, based on a total weight of the second phase, 7–15 wt % of W, 2–7 wt % of V, 1–7 wt % of Cr, 0.1–0.6 wt % of Si, 0.2–1 wt % of Mn. 0.1–0.6 wt % of S, up to 2.2 wt % of C, and a balance consisting of Fe and inevitable impurity. 0.3–1.6 wt % of first MnS grains, based on the total weight of the first phase, and first carbides of at least tungsten are dispersed in the first phase. The first carbides have fine particles. 0.3–1.6 wt % of second MnS grains, based on the total weight of the second phase, and second carbides of at least tungsten are dispersed in the second phase. The second carbides include tungsten carbides having a particle diameter of at least 1 $\mu$m and is in an amount of 10–20 areal %, based on a total area of the second phase. The first phases are in an amount of from 20 to 80 wt %, based on a total weight of the first and second phases. The first and second phases are distributed in the sintered alloy, in a form of spots. 0.3–1.6 wt % of third MnS grains, based on the total weight of the sintered alloy, are dispersed in boundaries surrounding grains of said first and second phases and/or in pores of the sintered alloy.

According to a second aspect of the present invention, there is provided a second high-temperature wear-resistant sintered alloy that is identical with the first sintered alloy, except that the vanadium content of the sintered alloy is 0.79–5.88 wt %, in place of 0.39–5.68 wt %, based on the total weight of the sintered alloy, and that the first phase further comprises 0.5–1.5 wt % of V, based on the total weight of the first phase.

It is needless to say that each of the first and second sintered alloys may contain inevitable impurities.

DESCRIPTION OF THE PREFERRED EMBODIMENTS

Figure 1A:
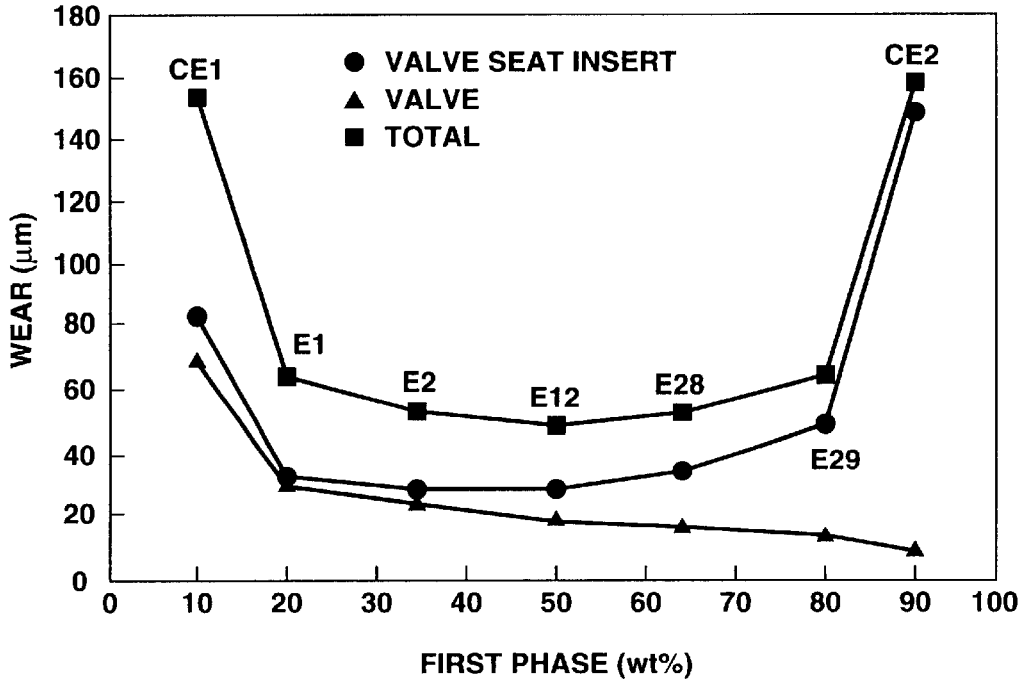
FIG. 1A is a graph showing the variations of wears of valve seat insert, valve and their total, with the first phase content of the total of the first and second phases.
Figure 1B:
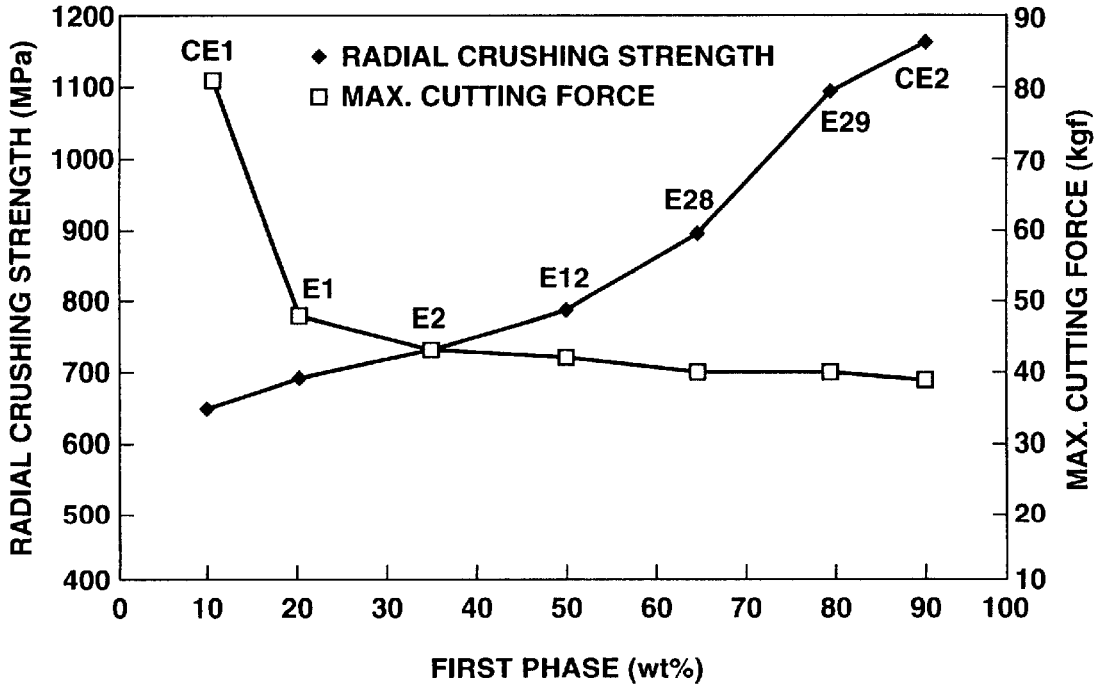
FIG. 1B is a graph similar to FIG. 1A, but showing the variations of the radial crushing strength and the maximum cutting force.

A high-temperature wear-resistant sintered alloy according to the present invention is further improved in wear resistance, while suppressing damage to a mating part that is in contact with the sintered alloy, as compared with U.S. Pat. No. 5,949,003, of which disclosure is incorporated herein by reference. For this improvement, it is preferable to suitably adjust the sizes and the amounts of carbides dispersed in the first and second phases of the sintered alloy, as will be explained hereinafter. As stated above, the first and second MnS grains are respectively dispersed in the first and second phases, and the third MnS grains are dispersed in boundaries surrounding grains of the first and second phases and/or in pores of the sintered alloy. Due to the provision of such first, second and third MnS grains in the sintered alloy, the sintered alloy is improved in machinability, without damaging the sintered alloy in strength and wear resistance. As stated above, the sintered alloy according to the present invention has a special structure in which the first and second phases, each preferably having an average particle diameter of 20–150 μm, are distributed in the sintered alloy, in the form of spots. In other words, the first phase spots are well blended with the second phase spots, and both spots are distributed at random in the sintered alloy. The first phase of this special structure contains first carbides of at least tungsten, dispersed therein, and these first carbides have fine particles having a preferable particle diameter of up to 1 μm. In fact, the first carbides contain tungsten as a major element thereof and may contain at least one other minor elements except tungsten and carbon. In contrast with the first phase, the second phase contains second carbides of at least tungsten, dispersed therein, and these second carbides include second (larger) tungsten carbides having a particle diameter of at least 1 μm, being in an amount of 10–20 areal %, based on the total area of the second phase, and being dispersed in the second phase. Furthermore, the second phase preferably contains other carbides uniformly dispersed therein, which are mainly made up of first (smaller) tungsten carbides having a particle diameter of up to 1 μm and a vanadium carbide also having a particle diameter of up to 1 μm. Still furthermore, the second phase is reinforced with chromium, relative to the first phase, as is clear from the difference between the chromium content of the first phase and that of the second phase. The second phase, in which the first larger tungsten carbides are dispersed, can be defined as being hard, and in contrast the first phase can be defined as being soft. Due to the provision of the above-mentioned first and second phases in the form of spots in the sintered alloy, the sintered alloy is improved in wear resistance and machinability, while suppressing damage to a mating part that is in contact with the sintered alloy. As mentioned above, the sintered alloy can be defined as having a special structure in which soft spots of the first phase and hard spots of the second phase are well blended with each other.

In the preset invention, if the tungsten content of the first phase of the sintered alloy is greater than 7 wt %, the sintered alloy used as the valve seat insert becomes strong in the property of damaging the valve. If the tungsten content thereof is less than 3 wt %, the sintered alloy becomes inferior in wear resistance. As the chromium content of the first phase of the sintered alloy increases, the sintered alloy used as the valve seat insert becomes stronger in the property of damaging the valve. Thus, chromium may be omitted in the first phase of the sintered alloy, but the first phase may contain up to 1 wt % of chromium generated by the diffusion from the second phase into the first phase, at the time of sintering. If the chromium content of the first phase after the sintering is greater than 1 wt %, the first phase may be reinforced too much, resulting in a small difference between the first and second phases in hardness. With this, the sintered alloy becomes stronger in the property of damaging the valve.

In the present invention, if the tungsten content of the second phase of the sintered alloy is greater than 15 wt %, the sintered alloy becomes strong in the property of damaging the valve. If the tungsten content thereof is less than 7 wt %, the sintered alloy becomes inferior in wear resistance. Even if the tungsten content thereof is in the range of 7–15 wt %, the sintered alloy becomes inferior in wear resistance in a condition that all of tungsten carbides of the second phase have a particle diameter of less than 1 μm. Of course, this condition is not the case of the present invention. If the second larger tungsten carbide content of the second phase is greater than 20 areal %, the sintered alloy becomes strong in the property of damaging the valve. In contrast, if it is less than 10 areal %, the sintered alloy becomes inferior in wear resistance. If the vanadium content of the second phase of the sintered alloy is greater than 7 wt %, the sintered alloy becomes strong in the property of damaging the valve. If the vanadium content thereof is less than 2 wt %, the sintered alloy becomes inferior in wear resistance. If vanadium carbide dispersed in the second phase has a particle diameter of greater than 1 μm, the sintered alloy becomes strong in the property of damaging the valve. Due to the inclusion of 1–7 wt % of chromium in the second phase of the sintered alloy, the sintered alloy becomes improved in hardenability. With this, it becomes possible to deposit the MC-type hard vanadium carbide in the second phase, If the chromium content of the second phase is greater than 7 wt %, the sintered alloy becomes strong in the property of damaging the valve. If it is lower than 1 wt %, it becomes inferior in wear resistance.

In the present invention, the silicon content of each of the total of the sintered alloy and its first and second phases is adjusted to a range of from 0.1 to 0.6 wt %, as mentioned above. If it is greater than 0.6 wt %, the sintered alloy becomes low in hardness. If it is lower than 0.1 wt %, it becomes low in hardness, too, due to the inferior sinterability.

Manganese of the first and second phases exists therein basically in the form of MnS grains, thereby improving the sintered alloy in machinability. If the amount of manganese is excessive relative to that of sulfur, the excess of manganese blends into the first and/or second phase, thereby improving the same in strength. The first or second phase becomes inferior in strength, in case that the MnS grains content thereof is greater than 1.6 wt % or that the manganese content thereof is greater than 1 wt %. In contrast, the sintered alloy becomes inferior in machinability, in case that the MnS grains content of the first and/or second phase is less than 0.3 wt % or that the manganese content thereof is less than 0.2 wt %. If the amount of manganese blended into the first or second phase is at least 0.1 wt %, the first or second phase may be improved in strength. If the amount thereof is greater than 0.6 wt %, the sintered alloy may become inferior in strength due to inferior sinterability.

Sulfur of the first and second phases exists therein basically in the form of MnS grains, thereby improving the sintered alloy in machinability. If the amount of sulfur is excessive relative to that of manganese, the excess of sulfur is combined with chromium to form chromium sulfide grains, thereby improving the sintered alloy in machinability. In fact, MnS grain is superior to chromium sulfide grain in the improvement of machinability. Therefore, it is preferable to add sulfur only in an amount necessary for forming MnS grains. The first or second phase becomes inferior in strength in case that the sulfur content thereof is 0.6 wt %. In contrast, the sintered alloy is not so improved in machinability if the sulfur content of the first or second phase is less than 0.1 wt %.

In the present invention, if the amount of the first phase (soft) is less than 20 wt % based on the total weight of the first and second phases, the amount of the second phase (hard) becomes too much. With this, the sintered alloy becomes strong in the property of damaging the valve. In contrast, if it is greater than 80 wt %, the sintered alloy becomes low in wear resistance.

As mentioned above, the first and second MnS grains contents of the first and second phases each have the upper limit of 1.6 wt %. Furthermore, according to the invention, the third MnS grains are dispersed outside of the first and second phases, that is, in the boundaries surrounding grains of the first and second phases and/or in pores of the sintered alloy. With this, the sintered alloy is improved in machinability without lowering the sintered alloy in strength. If the third MnS grains content is greater then 1.6 wt %, it makes the powder mixture low in compactability and interferes with the sintering. Thus, it makes the sintered alloy low in strength. 1.6 wt % of the third MnS grains refers to 1.01 wt % of Mn and 0.59 wt % of S. If the third MnS grains content is less than 0.3 wt %, the sintered alloy is not so improved in machinability.

According to the second aspect of the present invention, the first phase of the sintered alloy further comprises 0.5–1.5 wt % of V. With this, the sintered alloy is further improved in corrosion resistance and in wear resistance even under a condition that the sintered alloy is used, for example, as a valve seat insert of an internal combustion engine running with leaded gasoline. If it is less than 0.5 wt %, the sintered alloy becomes insufficient in corrosiveness, resulting in lowered wear resistance. If it is greater than 1.5 wt %, too much amount of vanadium carbide deposits in the first phase. With this, the sintered alloy becomes strong in the property of damaging the valve.

In the present invention, the sintered alloy can be further improved in machinability by incorporating acrylic resin into the sintered alloy. This is conducted by impregnating pores of the sintered alloy with a melt of acrylic resin. If the sintered alloy is cut by a machine tool in a condition that the pores are kept empty by omitting this impregnation, the cutting condition becomes a so-called intermittent cutting condition in which the blade edge of the machine tool receives shocks repeatedly due to the random distribution of empty pores and solid phase. In contrast, if the sintered alloy is cut in a condition that the pores are occupied with acrylic resin, the cutting condition becomes a so-called continuous cutting condition. With this, the shock against the blade edge is reduced. Furthermore, the amount of plastic deformation of the sintered alloy upon cutting can be reduced due to the resistance of the acrylic resin in the pores, as compared with the condition in which the pores are kept empty. With this, it becomes possible to reduce the cutting loss.

In the present invention, the sintered alloy can be further improved in machinability by incorporating a metal that is one of metallic copper and a copper alloy into the sintered alloy. This is conducted by infiltrating pores of the sintered alloy with a melt of this metal. The incorporation of the metal can brings about the same advantageous effects as those of the incorporation of acrylic resin. Furthermore, it becomes possible to release the cutting heat generated at the cutting point of the blade edge, since the metal is superior in thermal conductivity. With this, it becomes possible to prevent the heat accumulation of the blade edge, thereby reducing the damage thereto.

The following nonlimitative examples are illustrative of the present invention.

EXAMPLES 1–29 & COMPARATIVE EXAMPLES 1–15

In each of these examples and comparative examples, a first powder (each of 1A–1M in Table 1) having an average particle diameter of from 20 to 150 $\mu$m and a chemical composition shown in Table 1, was prepared for the use as a raw material of the first phase of the sintered alloy. Furthermore, a second powder (each of 2A–2Q in Table 2) having an average particle diameter of from 20 to 150 $\mu$m and a chemical composition shown in Table 2, was prepared for the use as a raw material of the second phase of the sintered alloy. Then, as shown in Table 3, each powder mixture was prepared by blending the first powder (one of 1A–1M), the second powder (one of 2A–2Q), a graphite powder, a MnS powder, and zinc stearate used as a lubricant, for 30 min, using a mixer. For example, 19.64 wt % of the first powder (1D) and 78.41 wt % of the second powder (2I) were used in Example 1. Then, each powder mixture was subjected to a pressure of 6.5 ton f/cm$^2$, thereby preparing a ringlike powder compact having an inner diameter of 20 mm, an outer diameter of 40 mm, and a thickness of 10 mm. After that, the powder compacts were sintered in an atmosphere of a destructive ammonia gas at 1180° C. for 30 min, thereby obtaining sintered alloys having chemical compositions as shown in Tables 4 and 5. In fact, the areal %, based on the total area of the second phase, of tungsten carbide (WC) having a particle diameter of at least 1 $\mu$m is shown in Table 5.

Only the sintered alloy according to Example 14 was infiltrated with melted copper by putting a copper powder compact on the sintered alloy, and then by keeping it in an atmosphere of a destructive ammonia gas at 1140° C. for 30 min. Furthermore, only the sintered alloy according to Example 13 was impregnated with an acrylic resin by a vacuum impregnation method, followed by curing in hot water heated at 100° C.

TABLE 1

| 1st Powder | Powder Composition (wt %) | | | | | | | | MnS |
|---|---|---|---|---|---|---|---|---|---|
| | Fe | W | V | Si | Mn | S | C | O | (wt %) |
| 1A | Balance | 5.00 | 0.00 | 0.30 | 0.15 | 0.09 | 0.60 | 0.30 | 0.24 |
| 1B | Balance | 5.00 | 0.00 | 0.30 | 0.20 | 0.11 | 0.60 | 0.30 | 0.30 |
| 1C | Balance | 5.00 | 0.00 | 0.30 | 0.40 | 0.23 | 0.60 | 0.30 | 0.62 |
| 1D | Balance | 5.00 | 0.00 | 0.30 | 0.60 | 0.30 | 0.60 | 0.30 | 0.81 |
| 1E | Balance | 5.00 | 0.00 | 0.30 | 0.80 | 0.47 | 0.60 | 0.30 | 1.27 |
| 1F | Balance | 5.00 | 0.00 | 0.30 | 1.00 | 0.58 | 0.60 | 0.30 | 1.57 |
| 1G | Balance | 5.00 | 0.00 | 0.30 | 1.20 | 0.70 | 0.60 | 0.30 | 1.90 |
| 1H | Balance | 5.00 | 0.30 | 0.30 | 0.60 | 0.30 | 0.60 | 0.30 | 0.81 |
| 1I | Balance | 5.00 | 0.50 | 0.30 | 0.60 | 0.30 | 0.60 | 0.30 | 0.81 |
| 1J | Balance | 5.00 | 0.80 | 0.30 | 0.60 | 0 30 | 0.60 | 0.30 | 0.81 |
| 1K | Balance | 5.00 | 1.20 | 0.30 | 0.60 | 0.30 | 0.60 | 0.30 | 0.81 |
| 1L | Balance | 5.00 | 1.50 | 0.30 | 0.60 | 0.30 | 0.60 | 0.30 | 0.81 |
| 1M | Balance | 5.00 | 1.80 | 0.30 | 0.60 | 0.30 | 0.60 | 0.30 | 0.81 |

TABLE 2

| 2nd Powder | Powder Composition (wt %) Fe | W | V | Cr | Si | Mn | S | C | O | MnS (wt %) |
|---|---|---|---|---|---|---|---|---|---|---|
| 2A | Balance | 5.00 | 5.00 | 4.00 | 0.30 | 0.60 | 0.30 | 0.60 | 0.30 | 0.81 |
| 2B | Balance | 7.00 | 5.00 | 4.00 | 0.30 | 0.60 | 0.30 | 0.60 | 0.30 | 0.81 |
| 2C | Balance | 9.00 | 5.00 | 4.00 | 0.30 | 0.60 | 0.30 | 0.60 | 0.30 | 0.81 |
| 2D | Balance | 12.00 | 5.00 | 4.00 | 0.30 | 0.15 | 0.09 | 0.60 | 0.30 | 0.24 |
| 2E | Balance | 12.00 | 5.00 | 4.00 | 0.30 | 0.20 | 0.11 | 0.60 | 0.30 | 0.30 |
| 2F | Balance | 12.00 | 5.00 | 4.00 | 0.30 | 0.40 | 0.23 | 0.60 | 0.30 | 0.62 |
| 2G | Balance | 12.00 | 5.00 | 4.00 | 0.30 | 0.60 | 0.30 | 0.20 | 0.30 | 0.81 |
| 2H | Balance | 12.00 | 5.00 | 4.00 | 0.30 | 0.60 | 0.30 | 0.40 | 0.30 | 0.81 |
| 2I | Balance | 12.00 | 5.00 | 4.00 | 0.30 | 0.60 | 0.30 | 0.60 | 0.30 | 0.81 |
| 2J | Balance | 12.00 | 5.00 | 4.00 | 0.30 | 0.60 | 0.30 | 0.80 | 0.30 | 0.81 |
| 2K | Balance | 12.00 | 5.00 | 4.00 | 0.30 | 0.60 | 0.30 | 0.90 | 0.30 | 0.81 |
| 2L | Balance | 12.00 | 5.00 | 4.00 | 0.30 | 0.60 | 0.30 | 1.00 | 0.30 | 0.81 |
| 2M | Balance | 12.00 | 5.00 | 4.00 | 0.30 | 0.80 | 0.47 | 0.60 | 0.30 | 1.27 |
| 2N | Balance | 12.00 | 5.00 | 4.00 | 0.30 | 1.00 | 0.58 | 0.60 | 0.30 | 1.57 |
| 2O | Balance | 12.00 | 5.00 | 4.00 | 0.30 | 1.20 | 0.70 | 0.60 | 0.30 | 1.90 |
| 2P | Balance | 15.00 | 5.00 | 4.00 | 0.30 | 0.60 | 0.30 | 0.60 | 0.30 | 0.81 |
| 2Q | Balance | 20.00 | 5.00 | 4.00 | 0.30 | 0.60 | 0.30 | 0.60 | 0.30 | 0.81 |

TABLE 3

| | Powder Mixture Composition (wt %) 1st Powder | 2nd Powder | MnS Powder | Graphite Powder |
|---|---|---|---|---|
| Example 1 | 1D (19.64) | 2I (78.41) | 0.90 | 0.88 |
| Example 2 | 1D (34.38) | 2I (63.54) | 0.90 | 0.88 |
| Example 3 | 1D (49.11) | 2B (48.68) | 0.90 | 0.88 |
| Example 4 | 1D (49.11) | 2C (48.68) | 0.90 | 0.88 |
| Example 5 | 1D (49.11) | 2H (48.68) | 0.90 | 0.88 |
| Example 6 | 1B (49.11) | 2I (48.68) | 0.90 | 0.88 |
| Example 7 | 1C (49.11) | 2I (48.68) | 0.90 | 0.88 |
| Example 8 | 1D (49.11) | 2E (48.68) | 0.90 | 0.88 |
| Example 9 | 1D (49.11) | 2F (48.68) | 0.90 | 0.88 |
| Example 10 | 1D (49.41) | 2I (48.97) | 0.30 | 0.88 |
| Example 11 | 1D (49.26) | 2I (48.83) | 0.60 | 0.88 |
| Example 12 | 1D (49.11) | 2I (48.68) | 0.90 | 0.88 |
| Example 13 | 1D (49.11) | 2I (48.68) | 0.90 | 0.88 |
| Example 14 | 1D (49.11) | 2I (48.68) | 0.90 | 0.88 |
| Example 15 | 1D (48.96) | 2I (48.53) | 1.20 | 0.88 |
| Example 16 | 1D (48.76) | 2I (48.33) | 1.60 | 0.88 |
| Example 17 | 1D (49.11) | 2M (48.68) | 0.90 | 0.88 |
| Example 18 | 1D (49.11) | 2N (48.68) | 0.90 | 0.88 |
| Example 19 | 1E (49.11) | 2I (48.68) | 0.90 | 0.88 |
| Example 20 | 1F (49.11) | 2I (48.68) | 0.90 | 0.88 |
| Example 21 | 1F (48.76) | 2N (48.33) | 1.60 | 0.88 |
| Example 22 | 1D (49.16) | 2J (48.78) | 0.90 | 0.78 |
| Example 23 | 1D (49.11) | 2P (48.68) | 0.90 | 0.88 |

TABLE 3-continued

| | Powder Mixture Composition (wt %) 1st Powder | 2nd Powder | MnS Powder | Graphite Powder |
|---|---|---|---|---|
| Example 24 | 1I (49.11) | 2I (48.68) | 0.90 | 0.88 |
| Example 25 | 1J (49.11) | 2I (48.68) | 0.90 | 0.88 |
| Example 26 | 1K (49.11) | 2I (48.68) | 0.90 | 0.88 |
| Example 27 | 1L (49.11) | 2I (48.68) | 0.90 | 0.88 |
| Example 28 | 1D (63.84) | 2I (33.81) | 0.90 | 0.88 |
| Example 29 | 1D (78.58) | 2I (18.95) | 0.90 | 0.88 |
| Com. Ex. 1 | 1D (9.82) | 2I (88.32) | 0.90 | 0.88 |
| Com. Ex. 2 | 1D (88.40) | 2I (9.04) | 0.90 | 0.88 |
| Com. Ex 3 | 1D (49.11) | 2A (48.68) | 0.90 | 0.88 |
| Com. Ex. 4 | 1D (49.11) | 2Q (48.68) | 0.90 | 0.88 |
| Com. Ex. 5 | 1A (49.11) | 2I (48.68) | 0.90 | 0.88 |
| Com. Ex. 6 | 1G (49.11) | 2I (48.68) | 0.90 | 0.88 |
| Com. Ex. 7 | 1D (49.11) | 2D (48.68) | 0.90 | 0.88 |
| Com. Ex. 8 | 1D (49.11) | 2O (48.68) | 0.90 | 0.88 |
| Com. Ex. 9 | 1D (49.51) | 2I (49.07) | 0.10 | 0.88 |
| Com. Ex. 10 | 1D (48.66) | 2I (48.24) | 1.80 | 0.88 |
| Com. Ex. 11 | 1D (49.01) | 2G (48.48) | 0.90 | 1.08 |
| Com. Ex. 12 | 1D (49.19) | 2K (48.83) | 0.90 | 0.73 |
| Com. Ex. 13 | 1D (49.21) | 2L (48.88) | 0.90 | 0.68 |
| Com. Ex. 14 | 1H (49.11) | 2I (48.68) | 0.90 | 0.88 |
| Com. Ex. 15 | 1M (49.11) | 2I (48.68) | 0.90 | 0.88 |

TABLE 4

| | Powder Composition (wt %) Fe | W | V | Cr | Si | Mn | S | C | O | MnS (wt %) |
|---|---|---|---|---|---|---|---|---|---|---|
| Example 1 | Balance | 10.39 | 3.92 | 3.14 | 0.29 | 1.16 | 0.63 | 1.47 | 0.29 | 1.70 |
| Example 2 | Balance | 9.34 | 3.18 | 2.54 | 0.29 | 1.16 | 0.63 | 1.47 | 0.29 | 1.70 |
| Example 3 | Balance | 5.86 | 2.43 | 1.95 | 0.29 | 1.16 | 0.63 | 1.47 | 0.29 | 1.70 |
| Example 4 | Balance | 6.84 | 2.43 | 1.95 | 0.29 | 1.16 | 0.63 | 1.47 | 0.29 | 1.70 |
| Example 5 | Balance | 8.30 | 2.43 | 1.95 | 0.29 | 1.16 | 0.63 | 1.37 | 0.29 | 1.70 |
| Example 6 | Balance | 8.30 | 2.43 | 1.95 | 0.29 | 0.96 | 0.53 | 1.47 | 0.29 | 1.44 |
| Example 7 | Balance | 8.30 | 2.43 | 1.95 | 0.29 | 1.06 | 0.59 | 1.47 | 0.29 | 1.60 |
| Example 8 | Balance | 8.30 | 2.43 | 1.95 | 0.29 | 0.96 | 0.53 | 1.47 | 0.29 | 1.45 |
| Example 9 | Balance | 8.30 | 2.43 | 1.95 | 0.29 | 1.06 | 0.59 | 1.47 | 0.29 | 1.60 |
| Example 10 | Balance | 8.35 | 2.45 | 1.96 | 0.30 | 0.78 | 0.41 | 1.47 | 0.30 | 1.10 |
| Example 11 | Balance | 8.32 | 2.44 | 1.95 | 0.29 | 0.97 | 0.52 | 1.47 | 0.29 | 1.40 |
| Example 12 | Balance | 8.30 | 2.43 | 1.95 | 0.29 | 1.16 | 0.63 | 1.47 | 0.29 | 1.70 |
| Example 13 | Balance | 8.30 | 2.43 | 1.95 | 0.29 | 1.16 | 0.63 | 1.47 | 0.29 | 1.70 |

TABLE 4-continued

| | Powder Composition (wt %) | | | | | | | | | MnS |
|---|---|---|---|---|---|---|---|---|---|---|
| | Fe | W | V | Cr | Si | Mn | S | C | O | (wt %) |
| Example 14 | Balance | 8.30 | 2.43 | 1.95 | 0.29 | 1.16 | 0.63 | 1.47 | 0.29 | 1.70 |
| Example 15 | Balance | 8.27 | 2.43 | 1.94 | 0.29 | 1.34 | 0.73 | 1.46 | 0.29 | 1.99 |
| Example 16 | Balance | 8.24 | 2.42 | 1.93 | 0.29 | 1.59 | 0.88 | 1.46 | 0.29 | 2.39 |
| Example 17 | Balance | 8.30 | 2.43 | 1.95 | 0.29 | 1.25 | 0.71 | 1.47 | 0.29 | 1.92 |
| Example 18 | Balance | 8.30 | 2.43 | 1.95 | 0.29 | 1.35 | 0.76 | 1.47 | 0.29 | 2.07 |
| Example 19 | Balance | 8.30 | 2.43 | 1.95 | 0.29 | 1.25 | 0.71 | 1.47 | 0.29 | 1.92 |
| Example 20 | Balance | 8.30 | 2.43 | 1.95 | 0.29 | 1.35 | 0.76 | 1.47 | 0.29 | 2.07 |
| Example 21 | Balance | 8.24 | 2.42 | 1.93 | 0.29 | 1.98 | 1.15 | 1.46 | 0.29 | 3.13 |
| Example 22 | Balance | 8.31 | 2.44 | 1.95 | 0.29 | 1.16 | 0.63 | 1.47 | 0.29 | 1.70 |
| Example 23 | Balance | 9.76 | 2.43 | 1.95 | 0 29 | 1.16 | 0.63 | 1.47 | 0.29 | 1.70 |
| Example 24 | Balance | 8.30 | 2.68 | 1.95 | 0.29 | 1.16 | 0.63 | 1.47 | 0.29 | 1.70 |
| Example 25 | Balance | 8.30 | 2.83 | 1.95 | 0.29 | 1.16 | 0.63 | 1.47 | 0.29 | 1.70 |
| Example 26 | Balance | 8.30 | 3.02 | 1.95 | 0.29 | 1.16 | 0.63 | 1.47 | 0.29 | 1.70 |
| Example 27 | Balance | 8.30 | 3.17 | 1.95 | 0.29 | 1.16 | 0.63 | 1.47 | 0.29 | 1.70 |
| Example 28 | Balance | 7.25 | 1.69 | 1.35 | 0.29 | 1.15 | 0.62 | 1.47 | 0.29 | 1.69 |
| Example 29 | Balance | 6.20 | 0.95 | 0.76 | 0.29 | 1.15 | 0.62 | 1.47 | 0.29 | 1.69 |
| Com. Ex. 1 | Balance | 11.09 | 4.42 | 3.53 | 0.29 | 1.16 | 0.63 | 1.47 | 0.29 | 1.70 |
| Com. Ex. 2 | Balance | 5.50 | 0.45 | 0.36 | 0.29 | 1.15 | 0.62 | 1.46 | 0.29 | 1.69 |
| Com. Ex. 3 | Balance | 4.89 | 2.43 | 1.95 | 0.29 | 1.16 | 0.63 | 1.47 | 0.29 | 1.70 |
| Com. Ex. 4 | Balance | 12.19 | 2.43 | 1.95 | 0.29 | 1.16 | 0.63 | 1.47 | 0.29 | 1.70 |
| Com. Ex. 5 | Balance | 8.30 | 2.43 | 1.95 | 0.29 | 0.93 | 0.52 | 1.47 | 0.29 | 1.41 |
| Com. Ex. 6 | Balance | 8.30 | 2.43 | 1.95 | 0.29 | 1.45 | 0.82 | 1.47 | 0.29 | 2.23 |
| Com. Ex. 7 | Balance | 8.30 | 2.43 | 1.95 | 0.29 | 0.94 | 0.52 | 1.47 | 0.29 | 1.42 |
| Com. Ex. 8 | Balance | 8.30 | 2.43 | 1.95 | 0.29 | 1.45 | 0.82 | 1.47 | 0.29 | 2.22 |
| Com. Ex. 9 | Balance | 8.36 | 2.45 | 1.96 | 0.30 | 0.65 | 0.33 | 1.47 | 0.30 | 0.90 |
| Com. Ex. 10 | Balance | 8.22 | 2.41 | 1.93 | 0.29 | 1.72 | 0.95 | 1.46 | 0.29 | 2.59 |
| Com. Ex. 11 | Balance | 8.27 | 2.42 | 1.94 | 0.29 | 1.15 | 0.62 | 1.47 | 0.29 | 1.69 |
| Com. Ex. 12 | Balance | 8.32 | 2.44 | 1.95 | 0.29 | 1.16 | 0.63 | 1.46 | 0.29 | 1.70 |
| Com. Ex. 13 | Balance | 8.33 | 2.44 | 1.96 | 0.29 | 1.16 | 0.63 | 1.46 | 0.29 | 1.70 |
| Com. Ex. 14 | Balance | 8.30 | 2.58 | 1.95 | 0.29 | 1.16 | 0.63 | 1.47 | 0.29 | 1.70 |
| Com. Ex. 15 | Balance | 8.30 | 3.32 | 1.95 | 0.29 | 1.16 | 0.63 | 1.47 | 0.29 | 1.70 |

TABLE 5

| | 1st Phase: | WC (≧1 μm) | | Test Results | | | | |
|---|---|---|---|---|---|---|---|---|
| | | | | Radial | Wear (μm) | | | Max. Cutting |
| | 2nd Phase by Weight | in 2nd Phase (areal %) | Gasoline Type | Crushing Strength (MPa) | Valve Seat Insert | Valve | Total | Force (kgf) |
| Example 1 | 20:80 | 15 | Unleaded | 686 | 33 | 32 | 65 | 48 |
| Example 2 | 35:65 | 15 | Unleaded | 733 | 29 | 25 | 54 | 43 |
| Example 3 | 50:50 | 15 | Unleaded | 760 | 41 | 20 | 61 | 39 |
| Example 4 | 50:50 | 15 | Unleaded | 775 | 32 | 18 | 50 | 41 |
| Example 5 | 50:50 | 10 | Unleaded | 803 | 31 | 20 | 51 | 41 |
| Example 6 | 50:50 | 15 | Unleaded | 808 | 29 | 18 | 47 | 49 |
| Example 7 | 50:50 | 15 | Unleaded | 796 | 30 | 20 | 50 | 44 |
| Example 8 | 50:50 | 15 | Unleaded | 800 | 30 | 18 | 48 | 49 |
| Example 9 | 50:50 | 15 | Unleaded | 793 | 29 | 20 | 49 | 44 |
| Example 10 | 50:50 | 15 | Unleaded | 801 | 29 | 20 | 49 | 48 |
| Example 11 | 50:50 | 15 | Unleaded | 796 | 30 | 19 | 49 | 48 |
| Example 12 | 50:50 | 15 | Unleaded | 788 | 30 | 20 | 50 | 42 |
| Example 13 | 50:50 | 15 | Unleaded | 790 | 37 | 20 | 57 | 30 |
| Example 14 | 50:50 | 15 | Unleaded | 792 | 38 | 18 | 56 | 34 |
| Example 15 | 50:50 | 15 | Unleaded | 768 | 31 | 21 | 52 | 38 |
| Example 16 | 50:50 | 15 | Unleaded | 710 | 43 | 19 | 62 | 32 |
| Example 17 | 50:50 | 15 | Unleaded | 760 | 31 | 20 | 51 | 40 |
| Example 18 | 50:50 | 15 | Unleaded | 752 | 37 | 19 | 56 | 36 |
| Example 19 | 50:50 | 15 | Unleaded | 763 | 31 | 19 | 50 | 39 |
| Example 20 | 50:50 | 15 | Unleaded | 751 | 36 | 20 | 56 | 36 |
| Example 21 | 50:50 | 15 | Unleaded | 737 | 35 | 17 | 52 | 21 |
| Example 22 | 50:50 | 20 | Unleaded | 775 | 30 | 22 | 52 | 45 |
| Example 23 | 50:50 | 15 | Unleaded | 790 | 36 | 23 | 59 | 47 |

TABLE 5-continued

| | 1st Phase: 2nd Phase by Weight | WC (≧1 μm) in 2nd Phase (areal %) | Gasoline Type | Test Results: Radial Crushing Strength (MPa) | Wear (μm): Valve Seat Insert | Wear (μm): Valve | Wear (μm): Total | Max. Cutting Force (kgf) |
|---|---|---|---|---|---|---|---|---|
| Example 24 | 50:50 | 15 | Leaded | 802 | 54 | 17 | 71 | 42 |
| Example 25 | 50:50 | 15 | Leaded | 815 | 51 | 17 | 68 | 43 |
| Example 26 | 50:50 | 15 | Leaded | 820 | 48 | 19 | 67 | 44 |
| Example 27 | 50:50 | 15 | Leaded | 823 | 54 | 21 | 75 | 46 |
| Example 28 | 65:35 | 15 | Unleaded | 901 | 36 | 18 | 54 | 40 |
| Example 29 | 80:20 | 15 | Unleaded | 1170 | 51 | 15 | 66 | 40 |
| Com. Ex. 1 | 10:90 | 15 | Unleaded | 640 | 84 | 71 | 155 | 81 |
| Com. Ex. 2 | 90:10 | 15 | Unleaded | 1100 | 150 | 10 | 160 | 39 |
| Com. Ex. 3 | 50:50 | 15 | Unleaded | 740 | 88 | 16 | 104 | 37 |
| Com. Ex. 4 | 50:50 | 15 | Unleaded | 785 | 88 | 84 | 172 | 76 |
| Com. Ex. 5 | 50:50 | 15 | Unleaded | 808 | 28 | 19 | 47 | 72 |
| Com. Ex. 6 | 50:50 | 15 | Unleaded | 560 | 66 | 53 | 119 | 21 |
| Com. Ex. 7 | 50:50 | 15 | Unleaded | 806 | 26 | 18 | 44 | 71 |
| Com. Ex. 8 | 50:50 | 15 | Unleaded | 551 | 63 | 49 | 112 | 23 |
| Com. Ex. 9 | 50:50 | 15 | Unleaded | 813 | 28 | 19 | 47 | 72 |
| Com. Ex. 10 | 50:50 | 15 | Unleaded | 522 | 73 | 60 | 133 | 24 |
| Com. Ex. 11 | 50:50 | 3 | Unleaded | 840 | 105 | 20 | 125 | 40 |
| Com. Ex. 12 | 50:50 | 25 | Unleaded | 743 | 35 | 40 | 75 | 62 |
| Com. Ex. 13 | 50:50 | 32 | Unleaded | 680 | 63 | 87 | 150 | 84 |
| Com. Ex. 14 | 50:50 | 15 | Leaded | 790 | 98 | 16 | 114 | 42 |
| Com. Ex. 15 | 50:50 | 15 | Leaded | 825 | 90 | 32 | 122 | 49 |

EVALUATION TESTS

A wear resistance test on the sintered alloys was conducted, as follows, in order to evaluate wear resistance of each sintered alloy. At first, the sintered alloys were formed into a shape of a valve seat insert of an internal combustion engine. In this test, each valve seat insert was installed on an exhaust port side of an internal combustion engine having in-line four cylinders with 16 valves and a displacement of 1,600 cc. These valves were made of SUH-36, and their valve faces were coated with stellite. The wear resistance test was conducted by operating the engine for 400 hr, with an engine rotation speed of 6,000 rpm, using an unleaded regular gasoline or a leaded gasoline (see Table 5). After the test, there was measured wear of each valve seat insert and the corresponding valve.

A machinability test on the sintered alloys was conducted, as follows. In this test, outer surfaces of 50 pieces of each sintered alloy having the ringlike shape were cut by a lathe, with a rotation speed of 525 rpm, a machining stock of 0.5 mm, a running speed of 0.1 mm per revolution, and a super hard chip, without using any cutting oil. In this test, the maximum cutting force of the lathe was recorded as the result.

Radial crushing strength of each sintered alloy having the ringlike shape was determined with an autograph under a condition of a cross head speed of 0.5 mm/min.

The results of the above tests are shown in Table 5 and FIGS. 1A–7B For example, CE1 and E1 in FIG. 1A respectively represents Comparative Example 1 and Example 1.

Figure 2A:
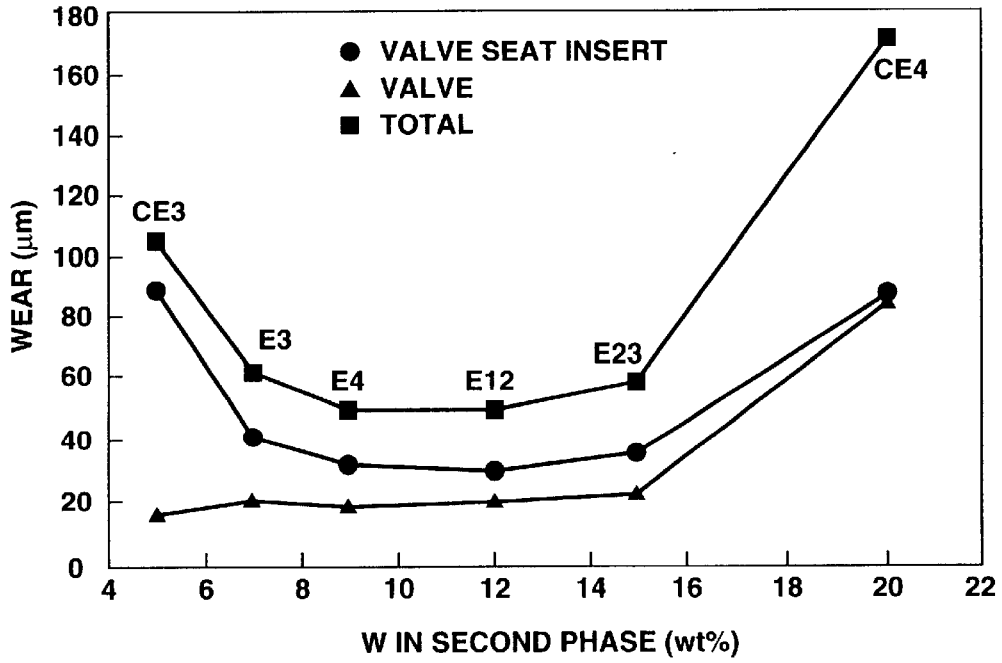
FIG. 2A is a graph similar to FIG. 1A, but showing those with the tungsten content of the second phase.
Figure 2B:
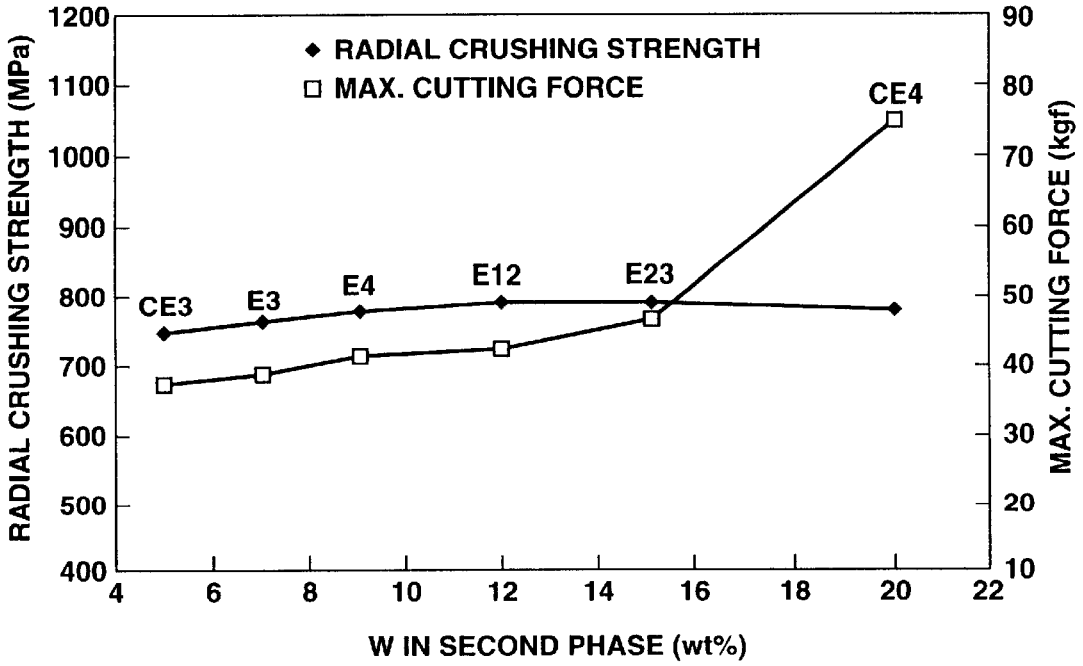
FIG. 2B is a graph similar to FIG. 2A, but showing the variations of the radial crushing strength and the maximum cutting force.
Figure 3A:
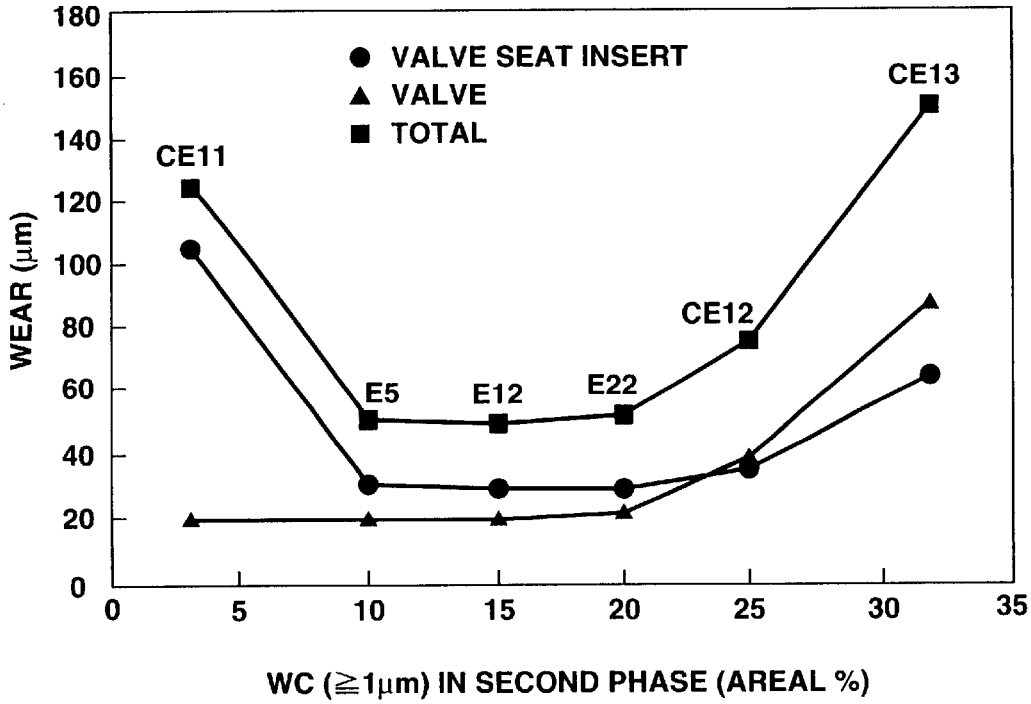
FIG. 3A is a graph similar to FIG. 1A, but showing those with the areal percentage of the first tungsten carbide (WC) having a particle diameter of at least 1 $\mu$m in the second phase.
Figure 3B:
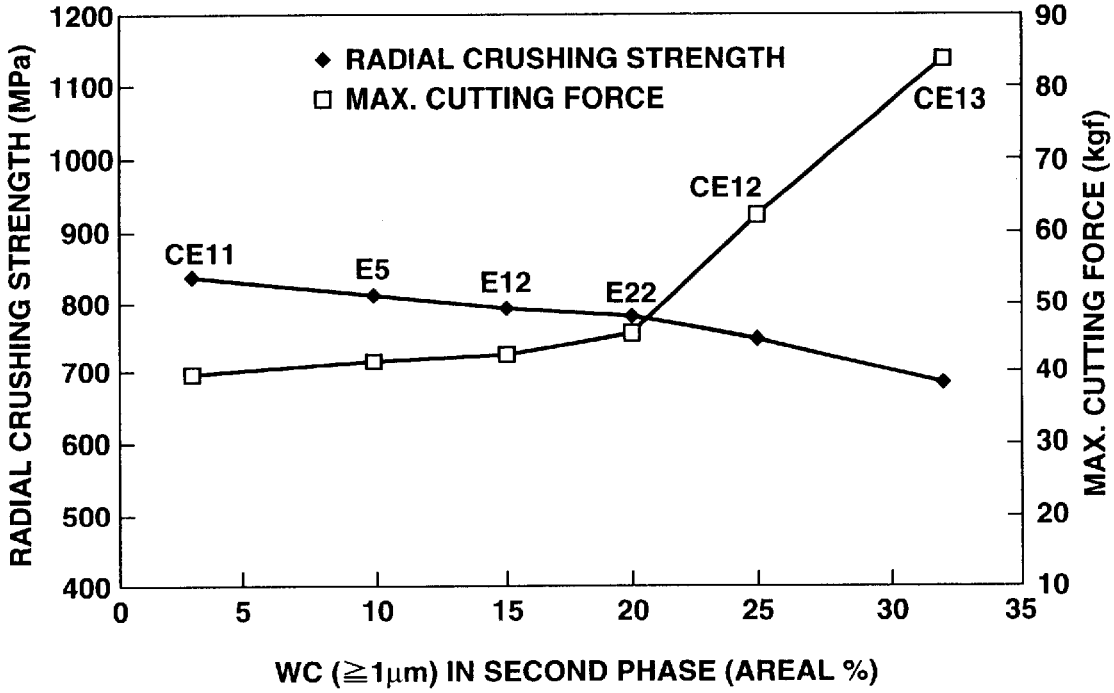
FIG. 3B is a graph similar to FIG. 3A, but showing the variations of the radial crushing strength and the maximum cutting force.
Figure 4A:
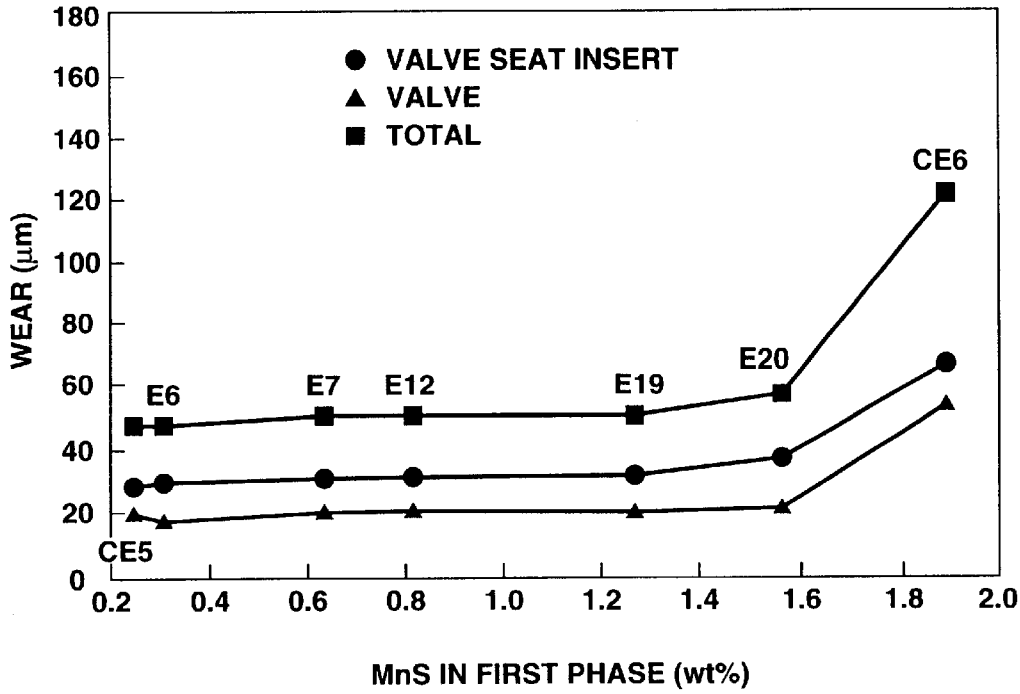
FIG. 4A is a graph similar to FIG. 1A, but showing those with the first MnS grains content of the first phase.
Figure 4B:
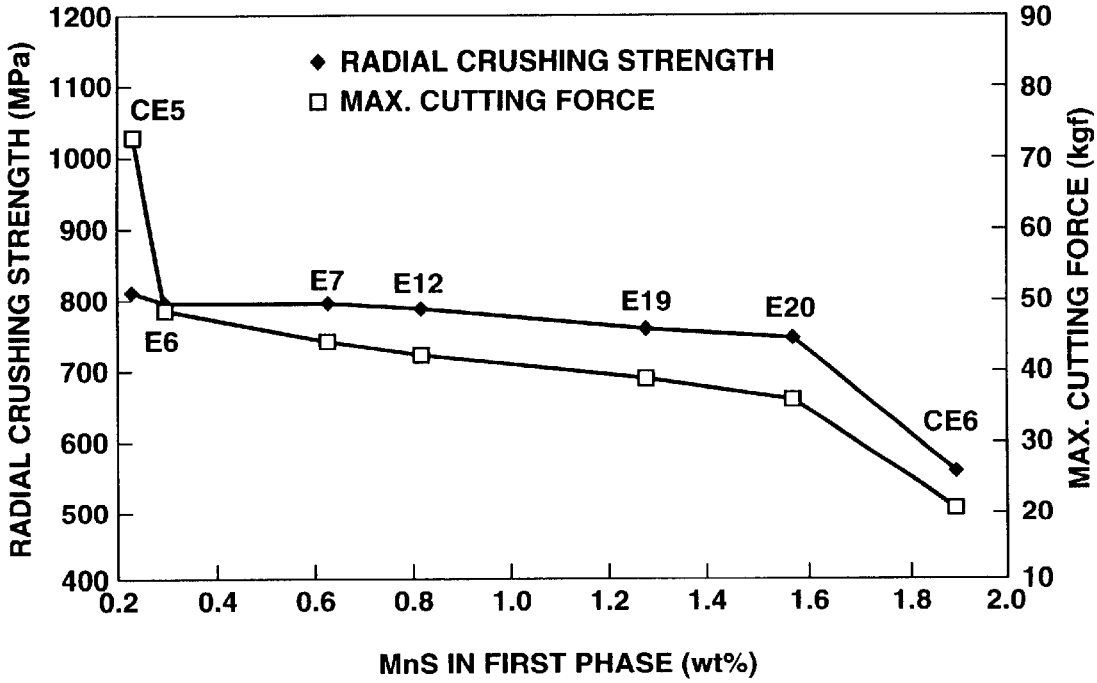
FIG. 4B is a graph similar to FIG. 4A, but showing the variations of the radial crushing strength and the maximum cutting force.
Figure 5A:
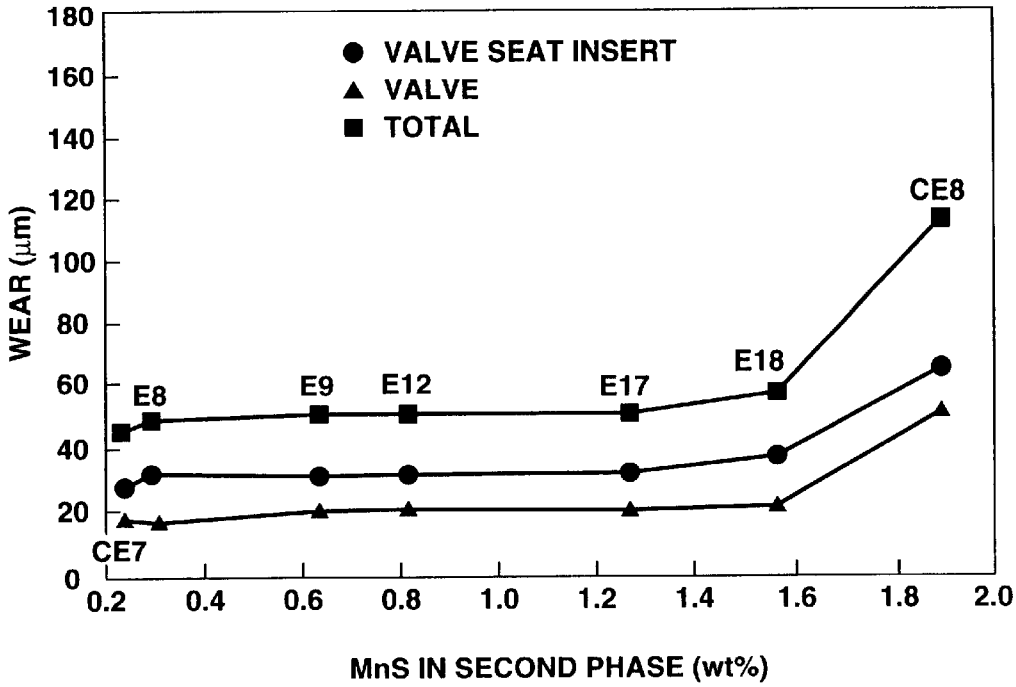
FIG. 5A is a graph similar to FIG. 1A, but showing those with the second MnS grains content of the second phase.
Figure 5B:
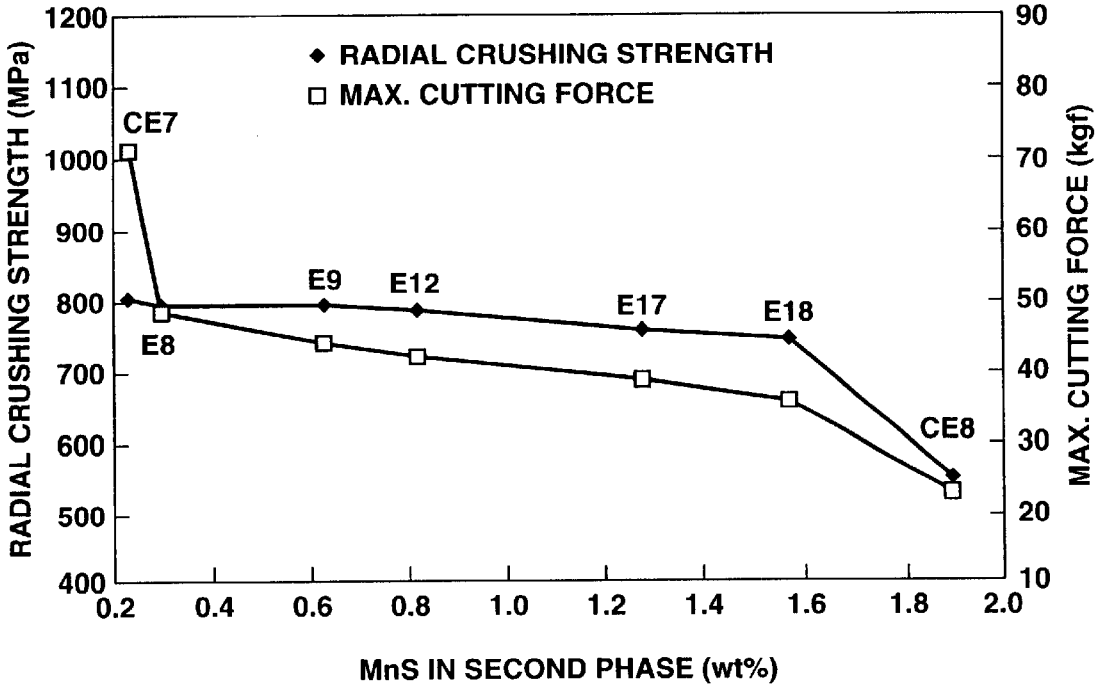
FIG. 5B is a graph similar to FIG. 5A, but showing the variations of the radial crushing strength and the maximum cutting force.
Figure 6A:
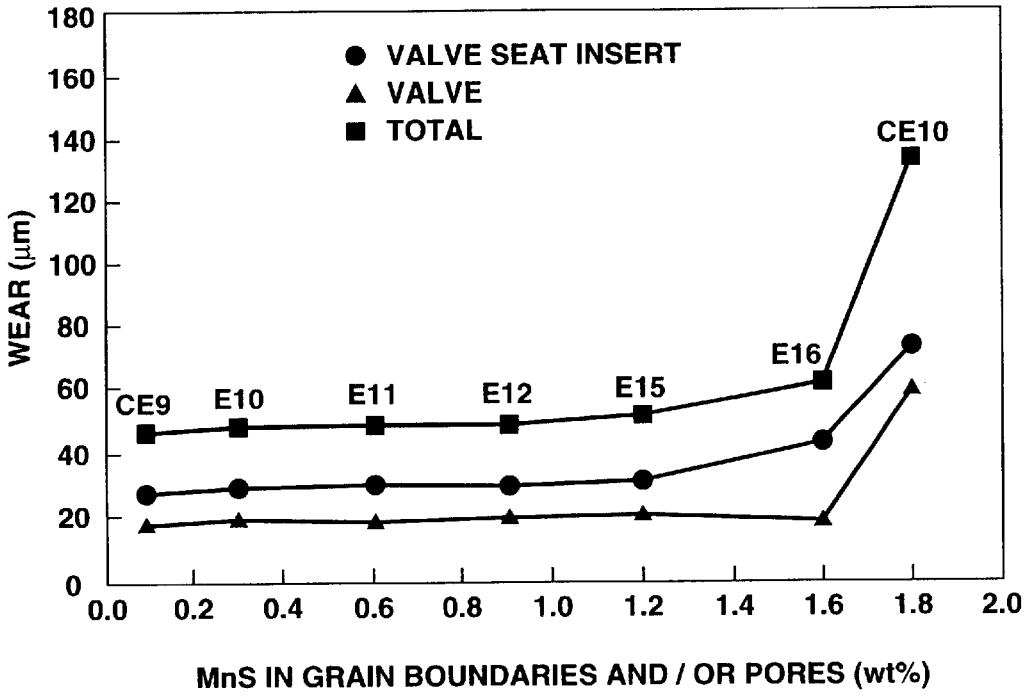
FIG. 6A is a graph similar to FIG. 1A, but showing those with the third MnS grains content of the sintered alloy, which are dispersed in grain boundaries and/or pores.
Figure 6B:
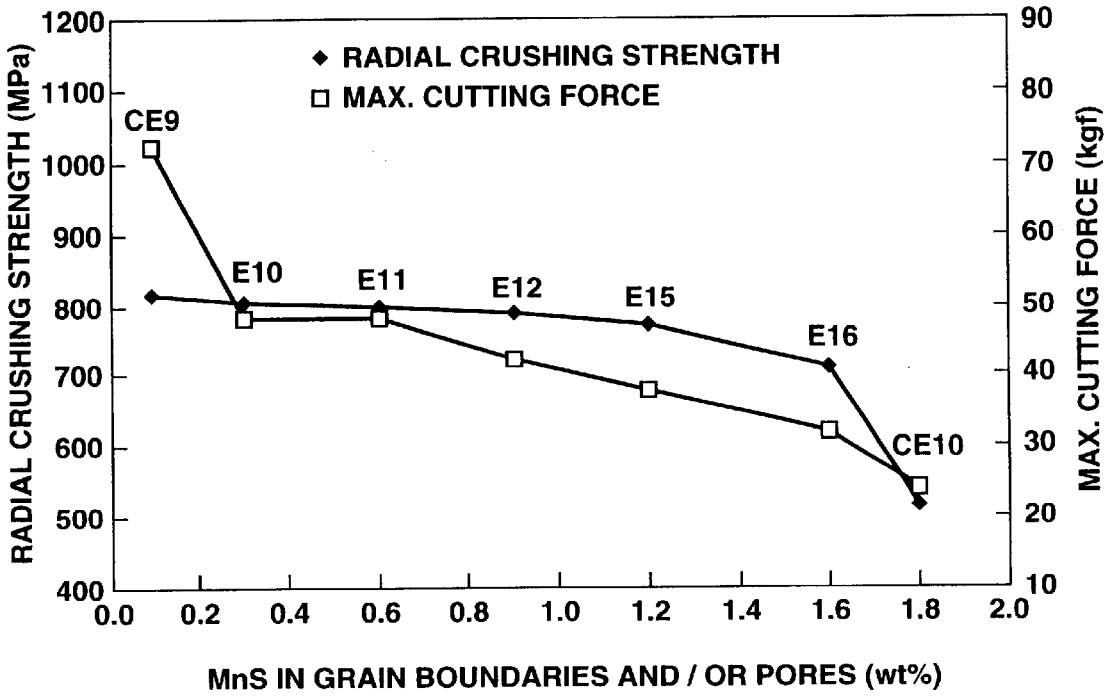
FIG. 6B is a graph similar to FIG. 6A, but showing the variations of the radial crushing strength and the maximumn cutting force.
Figure 7A:
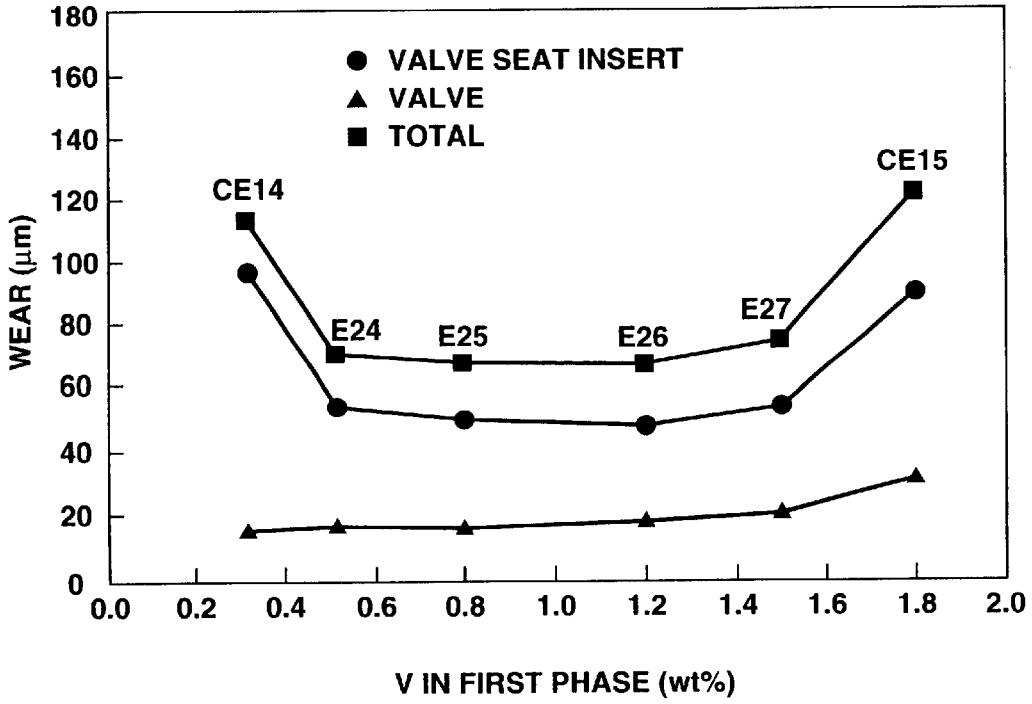
FIG. 7A is a graph similar to FIG. 1A, but showing those with the vanadium content of the first phase.
Figure 7B:
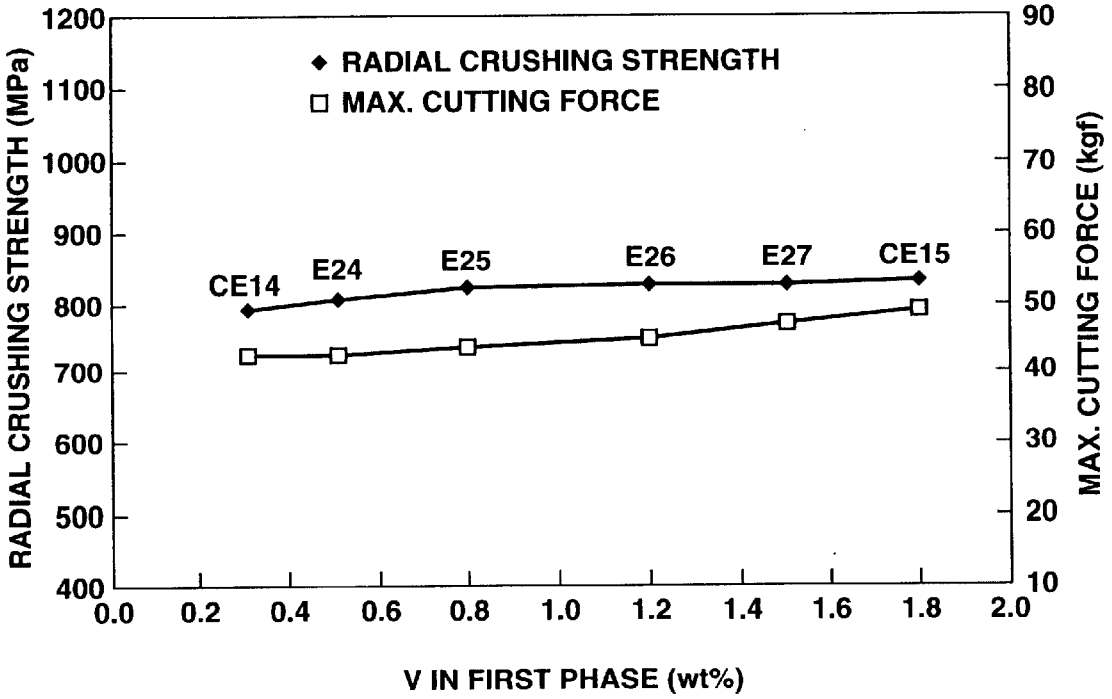
FIG. 7B is a graph similar to FIG. 7A, but showing the variations of the radial crushing strength and the maximum cutting force.

The results of the above tests were interpreted as follows. As shown in FIG. 1A and Table 5, it was interpreted that the wear under the use of unleaded gasoline becomes sufficiently low by adjusting the weight ratio of the first phase to the second phase to a range of from 20:80 to 80:20. As shown in FIG. 2A and Table 5, it was interpreted that the wear under the use of unleaded gasoline becomes sufficiently low by adjusting the tungsten content of the second phase to a range of from 7 to 15 wt %. As shown in FIG. 3A and Table 5, it was interpreted that the wear under the unleaded gasoline becomes sufficiently low by adjusting the areal %, based on the total area of the second phase, of tungsten carbide having a particle diameter of at least 1 μm to a range of from 10 to 20 areal %. As shown in FIG. 4B and Table 5, it was possible to substantially reduce the maximum cutting force by adding 0.3 wt % of the first MnS particles to the first phase, thereby improving machinability. As the first MnS particles content of the first phase increased further, although machinability improved, strength of the sintered alloy decreased as indicated by the decrease of the radial crushing strength in FIG. 4B. If the first MnS particles content of the first phase exceeds 1.6 wt %, the sintered alloy is embrittled, as indicated by the substantial decrease of the radial crushing strength in FIG. 4B, and thereby becomes inferior in wear resistance as shown in FIG. 4A. Thus, it was interpreted that the first MnS particles content of the first phase must be in a range of from 0.3 to 1.6 wt % Similar to the data shown in FIGS. 4A and 4B, it was interpreted that the second MnS particles content of the second phase must be a range of from 0.3 to 1.6 wt %, as shown in FIGS. 5A and 5B, and that the third MnS particles content of the sintered alloy, which are distributed in grain boundaries and/or pores of the first and second phases, must be in a range of from 0.3 to 1.6 wt %, as shown in FIGS. 6A and 6B. As shown in Table 5, the sintered alloy according to Example 21, in which each of the first, second and third MnS particles contents is 1.6 wt %, is further improved in machinability due to its decreased maximum cutting force (21 kgf), while this sintered alloy is satisfactory in wear resistance and strength. As shown in FIG. 7A and Table 5, it was interpreted that the wear under the use of leaded gasoline becomes sufficiently low by adjusting the vanadium content of the first phase to a range of from 0.5 to 1.5 wt %. By the test results comparison between Examples 12 and 13 in Table 5, it was interpreted that the sintered alloy becomes further improved in machinability by the acrylic resin impregnation, while this sintered alloy is satisfactory in wear resistance and strength. By the test results comparison between Examples 12 and 14 in Table 15, the sintered alloy becomes further improved in machinability by the Cu infiltration, while this sintered alloy is satisfactory in wear resistance and strength.

The entire disclosure of Japanese Patent Application No. 11-104435 filed on Apr. 12, 1999, including specification, claims, drawings and summary, of which priority is claimed in the present application, is incorporated herein by reference in its entirety.

What is claimed is:

1. A high-temperature wear-resistant sintered alloy comprising, based on a total weight of said sintered alloy, 3.74–13.36 wt % of W, 0.39–5.58 wt % of V, 0.2–5.78 wt % of Cr, 0.1–0.6 wt % of Si, 0.39–1.99 wt % of Mn, 0.21–1.18 wt % of S, up to 2.16 wt % of C, and a balance consisting of Fe and inevitable impurity, said sintered alloy including:

a first phase comprising, based on a total weight of said first phase, 3–7 wt % of W, up to 1 wt % of Cr, 0.1–0.6 wt % of Si, 0.2–1 wt % of Mn, 0.1–0.6 wt % of S, up to 2.2 wt % of C, and a balance consisting of Fe and inevitable impurity; and a second phase comprising, based on a total weight of said second phase, 7–15 wt % of W, 2–7 wt % of V, 1–7 wt % of Cr, 0.1–0.6 wt % of Si, 0.2–1 wt % of Mn, 0.1–0.6 wt % of S, up to 2.2 wt % of C, and a balance consisting of Fe and inevitable impurity, wherein 0.3–1.6 wt % of first MnS grains, based on the total weight of said first phase, and first carbides of at least tungsten are dispersed in said first phase, said first carbides having fine particles, wherein 0.3–1.6 wt % of second MnS grains, based on the total weight of said second phase, and second carbides of at least tungsten are dispersed in said second phase, and said second carbides include tungsten carbides having a particle diameter of at least 1 $\mu$m and being in an amount of 10–20 areal %, based on a total area of said second phase, wherein said first phases are in an amount of from 20 to 80 wt %, based on a total weight of said first and second phases, wherein said first and second phases are distributed in said sintered alloy, in a form of spots, wherein 0.3–1.6 wt % of third MnS grains, based on the total weight of said sintered alloy, are dispersed in boundaries surrounding grains of said first and second phases and/or in pores of said sintered alloy.

2. A high-temperature wear-resistant sintered alloy comprising, based on a total weight of said sintered alloy, 3.74–13.36 wt % of W, 0.79–5.88 wt % of V, 0.2–5.78 wt % of Cr, 0.1–0.6 wt % of Si, 0.39–1.99 wt % of Mn, 0.21–1.18 wt % of S, up to 2.16 wt % of C, and a balance consisting of Fe and inevitable impurity, said sintered alloy including:

a first phase comprising, based on a total weight of said first phase, 3–7 wt % of W, 0.5–1.5 wt % of V, up to 1 wt % of Cr, 0.1–0.6 wt % of Si, 0.2–1 wt % of Mn, 0.1–0.6 wt % of S, up to 2.2 wt % of C, and a balance consisting of Fe and inevitable impurity; and a second phase comprising, based on a total weight of said second phase, 7–15 wt % of W, 2–7 wt % of V, 1–7 wt % of Cr, 0.1–0.6 wt % of Si, 0.2–1 wt % of Mn, 0.1–0.6 wt % of S, up to 2.2 wt % of C, and a balance consisting of Fe and inevitable impurity, wherein 0.3–1.6 wt % of first MnS grains, based on the total weight of said first phase, and first carbides of at least tungsten are dispersed in said first phase, said first carbides having fine particles, wherein 0.3–1.6 wt % of second MnS grains, based on the total weight of said second phase, and second carbides of at least tungsten are dispersed in said second phase, and said second carbides include tungsten carbides having a particle diameter of at least 1 $\mu$m and being in an amount of 10–20 areal %, based on a total area of said second phase, wherein said first phases are in an amount of from 20 to 80 wt %, based on a total weight of said first and second phases, wherein said first and second phases are distributed in said sintered alloy, in a form of spots, wherein 0.3–1.6 wt % of third MnS grains, based on the total weight of said sintered alloy, are dispersed in boundaries surrounding grains of said first and second phases and/or in pores of said sintered alloy.

3. A sintered alloy according to claim 1, wherein said sintered alloy further comprises an acrylic resin incorporated into said sintered alloy by impregnating said pores of said sintered alloy with a melt of said acrylic resin.

4. A sintered alloy according to claim 1, wherein said sintered alloy further comprises a metal that is one of metallic copper and a copper alloy, said metal being incorporated into said sintered alloy by infiltrating said pores of said sintered alloy with a melt of said metal.

5. A sintered alloy according to claim 1, wherein said grains of said first and second phases have an average diameter of from 20 to 150 $\mu$m.

6. A sintered alloy according to claim 1, wherein said first carbide of said first phase has a particle diameter of up to 1 $\mu$m.

7. A sintered alloy according to claim 1, wherein said second phase further comprises a second tungsten carbide having a particle diameter of up to 1 $\mu$m and a vanadium carbide having a particle diameter of up to 1 $\mu$m, said second tungsten carbide and said vanadium carbide being uniformly dispersed in said second phase.

8. A sintered alloy according to claim 2, wherein said sintered alloy further comprises an acrylic resin incorporated into said sintered alloy by impregnating said pores of said sintered alloy with a melt of said acrylic resin.

9. A sintered alloy according to claim 2, wherein said sintered alloy further comprises a metal that is one of metallic copper and a copper alloy, said metal being incorporated into said sintered alloy by infiltrating said pores of said sintered alloy with a melt of said metal.

10. A sintered alloy according to claim 2, wherein said grains of said first and second phases have an average diameter of from 20 to 150 $\mu$m.

11. A sintered alloy according to claim 2, wherein said first carbide of said first phase has a particle diameter of up to 1 $\mu$m.

12. A sintered alloy according to claim 2, wherein said second phase further comprises a second tungsten carbide having a particle diameter of up to 1 $\mu$m and a vanadium carbide having a particle diameter of up to 1 $\mu$m, said second tungsten carbide and said vanadium carbide being uniformly dispersed in said second phase.

* * * * *